United States Patent [19]

Kobayashi

[11] Patent Number: 4,986,208

[45] Date of Patent: Jan. 22, 1991

[54] ENGINE COVER CONSTRUCTION OF SMALL BOAT

[75] Inventor: Noboru Kobayashi, Kosai, Japan

[73] Assignee: Yamaha Hatsudoki Kabushiki Kaisha, Iwata, Japan

[21] Appl. No.: 934,727

[22] Filed: Nov. 25, 1986

[30] Foreign Application Priority Data

Nov. 26, 1985 [JP] Japan ..... 60-265885

[51] Int. Cl.[5] ..... B63B 35/86

[52] U.S. Cl. ..... 114/270; 114/144 R; 114/201 R

[58] Field of Search ..... 114/270, 343, 144 R, 114/201 R, 203, 154, 155, 156, 157, 158, 159, 160, 161; 440/1, 38, 40, 42, 47, 76, 77; 441/74, 72, 65; D12/307, 312, 314, 317, 318, 173, 174, 175, 178; 180/190, 69.21, 78, 334

[56] References Cited

U.S. PATENT DOCUMENTS

| | | | |
|---|---|---|---|
| 3,119,364 | 1/1964 | Brown | 440/1 |
| 3,426,724 | 2/1969 | Jacobson | 114/270 |
| 3,970,164 | 7/1976 | Suzuki | 180/69.21 X |
| 3,989,002 | 11/1976 | Peterson | 114/270 |
| 4,616,168 | 10/1986 | Nishida | 114/270 |
| 4,644,891 | 2/1987 | Niina | 114/201 R |

FOREIGN PATENT DOCUMENTS

| | | | |
|---|---|---|---|
| 1163674 | 9/1958 | France | 180/69.21 |

*Primary Examiner*—Sherman Basinger
*Assistant Examiner*—Thomas J. Brahan
*Attorney, Agent, or Firm*—Ernest A. Beutler

[57] ABSTRACT

A small boat embodying an improved hatch cover construction. The hatch cover is made from a thin light-weight material but is reinforced by a sub-frame and this reinforcing sub-frame rotatably journals the steering column.

10 Claims, 3 Drawing Sheets

ENGINE COVER CONSTRUCTION OF SMALL BOAT

BACKGROUND OF THE INVENTION

This invention relates to an engine cover construction for a small boat and more particularly to an improved, lightweight high strength hatch cover and steering cover for a boat.

One very popular type of boat is designed to be operated by a single rider and includes a steering arrangement ahead of the rider's seat and an engine compartment that is positioned beneath the steering column. As a result, the steering column is mounted by a removable hatch so as to afford access to the engine compartment. However, this type of watercraft is designed to be very light in weight and, as a result, it is desirable to form as much of the watercraft and specifically its hull from a lightweight material such as fiberglass or plastic, as is possible. Therefore, the removable hatch is preferably formed from a lightweight thin gage plastic but it must also serve the function of supporting the steering column. As a result, prior art constructions have formed the hatch cover from a relatively heavy walled material in order to provide the necessary structural strength for supporting the steering column. Thus, these prior art devices have not met their intended purpose.

It is, therefore, a principal object of this invention to provide an improved hatch cover for a watercraft.

It is another object of this invention to provide an improved lightweight and high strength hatch cover for a watercraft upon which the steering column can be supported.

SUMMARY OF THE INVENTION

This invention is adapted to be embodied in a small watercraft having a hull defining a rider's area and an opening which is formed in the hull forewardly of the rider's area. A hatch cover is provided for removably closing the opening and the hatch cover is formed from a lightweight thin material. A reinforcing member is affixed to the hatch cover for reinforcing it and for journaling a steering column.

DETAILED DESCRIPTION OF THE PREFERRED EMBODIMENT

Figure 1:
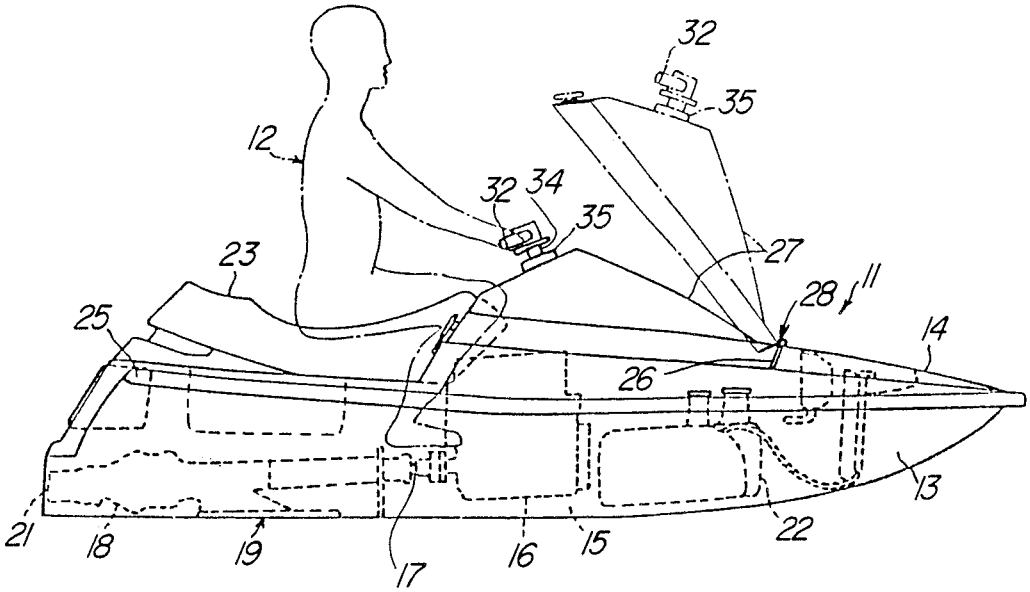
FIG. 1 is a side elevational view of a watercraft constructed in accordance with an embodiment of the invention. In the solid line view the hatch cover is shown in its closed position while in the phantom line view the hatch cover is shown in its opened position.
Figure 2:
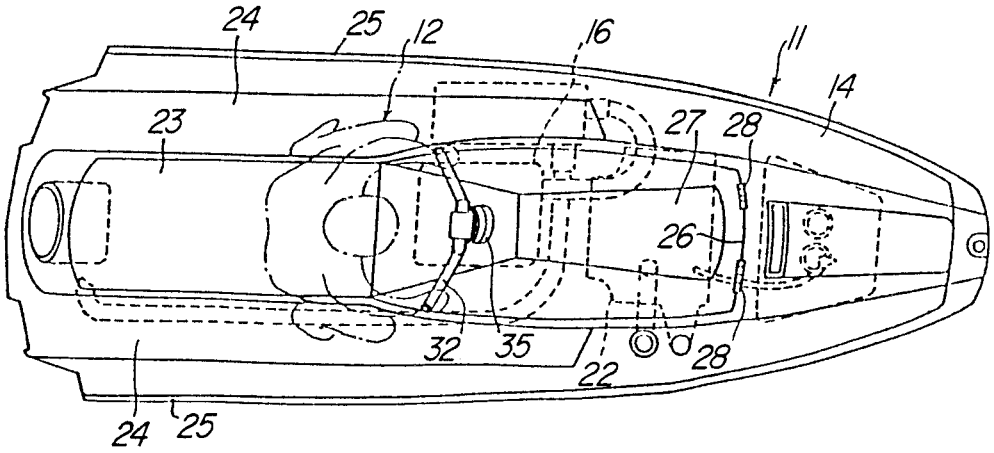
FIG. 2 is a top plan view of the watercraft.
Figure 3:
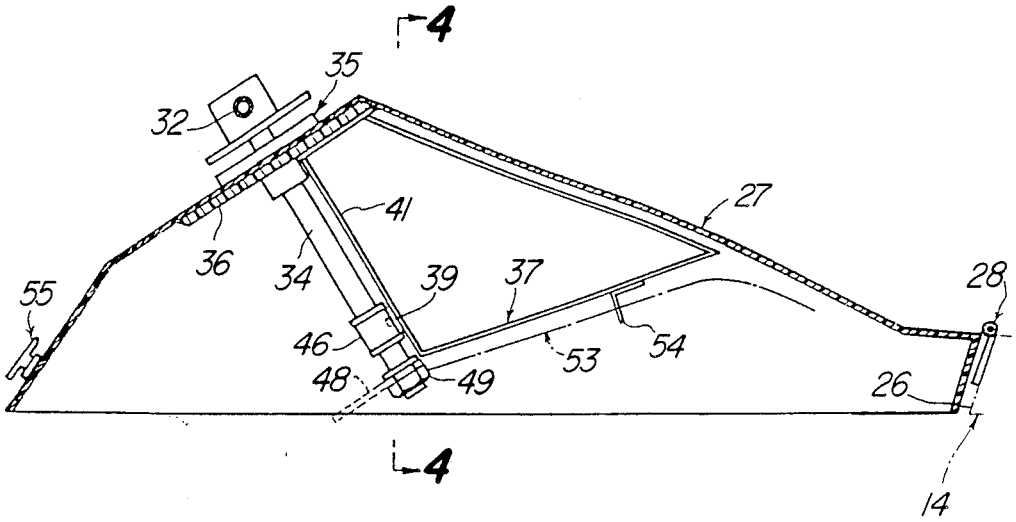
FIG. 3 is an enlarged cross-sectional view taken through the hatch cover along a longitudinal plane extending through the center of the steering column.

In the drawings, a watercraft constructed in accordance with an embodiment of the invention is identified generally by the reference numeral 11. The watercraft 11 is of the small, lightweight, jet propelled type and is designed so as to accomodate a single rider indicated in phantom and identified by the reference numeral 12.

The watercraft 11 is comprised of a hull consisting of a lower portion 13 and an upper deck 14. Preferably, the lower hull portion 13 and deck 14 are formed from a lightweight plastic material such as a molded fiberglass.

The hull 13 and specifically its lower portion define an engine compartment 15 in which an internal combustion engine 16 of any known type is positioned. The engine 16, in turn, drives a drive shaft 17 which, in turn, drives the impeller of a jet propulsion unit, indicated generally by the reference numeral 18. This jet propulsion unit, as is known in this art, includes a forwardly disposed water inlet 19 and a rearwardly disposed pivotal steering nozzle 21 through which the water is discharged.

Also positioned within the engine compartment 15 is a fuel tank 22. The fuel tank 22 is positioned forwardly of the engine 16.

Rearwardly of the deck 14 there is provided a seat 23 upon which the rider 12 may sit in a straddle-type fashion. Disposed on opposite sides of the seat 23 are a pair of recessed decks or footwells 24 into which the rider may place his feet and legs. The opposite sides of the footwells 24 are defined by a pair of raised gunnels 25 of the lower hull portion 13 and which may also be formed, in part, by rearwardly extending cantilevered portions of the upper deck 14.

Figure 4:
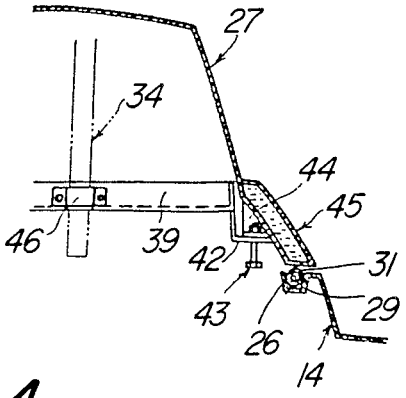
FIG. 4 is a cross-sectional view taken along the line 4—4 of FIG. 3.
Figure 5:
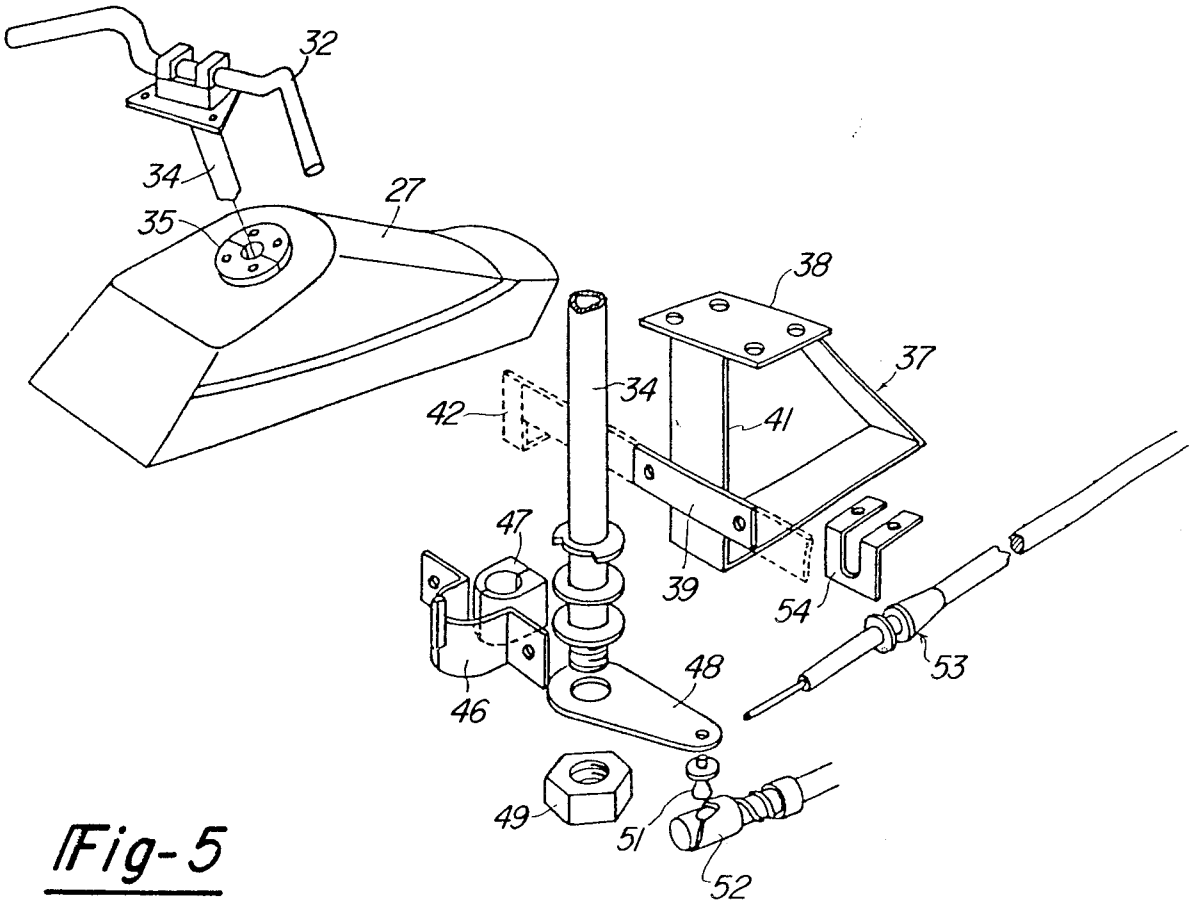
FIG. 5 is partially exploded view and its related components, with the components being shown in different scales so as to more clearly indicate the construction.

Forwardly of the seat 23 and above the engine compartment 15, the upper deck 14 is provided with an enlarged opening 26 that affords access to the engine 16 and fuel tank 22 and other auxiliaries of the watercraft. The opening 26 is closed by means of a hatch cover 27 that is pivotally connected to the deck 14 at the forward end of the opening 26 by means of one or more strap hinges 28. The deck 14 is provided with a peripheral flange 29 (FIG. 4) that encircles the opening 26 and which receives a seal 31 for sealing engagement with the hatch cover 27 when the hatch cover 27 is in its closed position.

In addition to closing the engine compartment access opening 26 the hatch cover 27 serves to support the steering handle bar 32 of the watercraft steering mechanism. The handle bar 32 is positioned forwardly of the seat 23 and is supported on a steering shaft 34 which extends through an inclined rearward upper face of the hatch cover 27. The steering shaft 34 is journaled at its upper end by means of a bearing 35 that is affixed to a reinforcing plate 36 that underlies the adjacent surface of the hatch cover 27.

In order to further reinforce the hatch cover 27 and journal the steering shaft 34, there is provided a sub-frame 37. The sub-frame 37 is made up of a welded bracket assembly that has a generally trapezoidal shape in side elevation and which includes an upper attaching plate 38 by which it is affixed to the underside of the reinforcing plate 36. In addition, a cross-member 39 is affixed to a vertical leg 41 of the sub frame 37 and extends to and is affixed at its opposite sides to the side walls of the hatch cover 27 by means of further reinforcing mechanisms including mounting brackets 42. The sub-frame consisting of the bracket portion and cross-beam 39 may be formed from a suitable, rigid material such as iron, steel or aluminum. As may be seen in FIG. 4, the attachment of the cross-beam 39 to the hatch cover 27 is accomplished by means of fasteners 43 that are affixed to ribs 44 formed integrally with the hatch cover 27. The ribs 44 may be formed adjacent hollow longitudinally extending sections 45 of the hatch cover which are filled with some form of reinforcing and buoyancy material.

The lower end of the steering column 34 is affixed to the cross-beam 39 by means of a mounting bracket 46 and associated anti-friction bearing 47. Below the bearing 47, the steering shaft 34 carries a steering arm 48 by means of a nut 49 and a suitable means for retaining it against rotation such as a key or key type connection. The outer end of the steering arm 48 carries a ball joint 51 that is connected to a female connector 52 which is, in turn, affixed to one end of a steering wire 53. The steering wire 53 has its protective sheath fixed relative to the sub-frame 37 by means of a bracket 54. The opposite end of the wire is connected in a suitable manner to the steering nozzle 21 for steering it in any known manner.

It should be readily apparent that the use of the flexible wire 53 for accomplishing steering permits the hatch cover 57 to be pivoted between its opened and closed positions without requiring any universal joints or disconection of the steering mechanism. However, other manners of accomplishing the steering and permitting this pivotal movement may be employed without departing the invention.

The rear end of the hatch cover 27 is provided with one or more handles 55 that may be grasped for facilitating opening and closing of the hatch cover 27. It should be readily apparent from the foregoing description that the described construction permits a lightweight easily manipulated hatch cover while at the same time offering a good and rigid support for the associated steering column. Those skilled in the art will readily realize that the invention is susceptable of use in other constructions than the preferred embodiment which has been illustrated and described without departing from the spirit and scope of the invention, as defined by the appended claims.

What is claimed:

1. In a small watercraft having a hull defining a rider's area, steering means carried by said hull for steering said hull in the water, an opening formed in said hull forwardly of said rider's area, a hatch cover for removably closing said opening, said hatch cover being formed from a lightweight thin material, a steering column, a reinforcing member affixed to said hatch cover and journaling said steering column, and means coupling said steering column to said steering means for steering said watercraft.

2. In a small watercraft as set forth in claim 1 wherein the hatch cover is pivotally supported by the hull for movement between an opened position and a closed position.

3. In a small watercraft as set forth in claim 2 wherein the means coupling the steering column to the steering means comprises a flexible transmitter.

4. In a small watercraft as set forth in claim 1 wherein the reinforcing member comprises a sub-frame.

5. In a small watercraft as set forth in claim 1 wherein the reinforcing member comprises a cross-beam.

6. In a small watercraft as set forth in claim 5 wherein the cross-beam is affixed to and forms a part of a sub-frame.

7. In a small watercraft as set forth in claim 6 wherein the hatch cover is pivotally supported by the hull for movement between an opened position and a closed position.

8. In a small watercraft as set forth in claim 7 further including an engine for driving the watercraft positioned beneath the opening and accessable therethrough when the hatch cover is pivoted to its opened position.

9. In a small watercraft as set forth in claim 8 wherein the sub-frame comprises a generally trapezoidal shape member in longitudinal cross-section to which the cross-beam is affixed in a perpendicular fashion.

10. In a small watercraft as set forth in claim 9 wherein the steering means comprises the steering nozzle of a jet drive unit and the steering column is coupled to said steering nozzle by means of a flexible transmitter for steering of the watercraft.

* * * * *